US008092896B2

(12) United States Patent
Erez et al.

(10) Patent No.: US 8,092,896 B2
(45) Date of Patent: Jan. 10, 2012

(54) CELLULAR CONFINEMENT SYSTEM

(75) Inventors: Oded Erez, Tel Aviv (IL); Adi Erez, Tel Aviv (IL)

(73) Assignee: PRS Mediterranean Ltd. (IL)

( * ) Notice: Subject to any disclaimer, the term of this patent is extended or adjusted under 35 U.S.C. 154(b) by 1104 days.

(21) Appl. No.: 11/575,251

(22) PCT Filed: Dec. 26, 2006

(86) PCT No.: PCT/IL2006/001486

§ 371 (c)(1),
(2), (4) Date: Mar. 14, 2007

(87) PCT Pub. No.: WO2007/074448

PCT Pub. Date: Jul. 5, 2007

(65) Prior Publication Data

US 2008/0248236 A1 Oct. 9, 2008

Related U.S. Application Data

(60) Provisional application No. 60/754,303, filed on Dec. 29, 2005.

(51) Int. Cl.
*B32B 3/24* (2006.01)

(52) U.S. Cl. ..... 428/133; 428/132; 428/116; 428/117; 405/258.1; 405/302.4

(58) Field of Classification Search ..... 428/132, 428/133, 116, 117; 405/258.1, 302.4
See application file for complete search history.

(56) References Cited

U.S. PATENT DOCUMENTS

| | | | | | |
|---|---|---|---|---|---|
| 4,481,242 | A | * | 11/1984 | Fletcher | 428/136 |
| 4,644,685 | A | * | 2/1987 | Tisbo et al. | 47/33 |
| 4,798,498 | A | | 1/1989 | Hallberg | |
| 4,965,097 | A | * | 10/1990 | Bach | 428/194 |
| 5,256,007 | A | * | 10/1993 | Allen | 405/302.4 |
| 6,296,924 | B1 | * | 10/2001 | Bach | 428/137 |
| 6,395,372 | B1 | * | 5/2002 | Bach | 428/137 |
| 6,554,545 | B1 | * | 4/2003 | Hall | 405/302.4 |

FOREIGN PATENT DOCUMENTS

| | | | |
|---|---|---|---|
| DE | 1915523 | A1 | 10/1969 |
| WO | WO0148324 | A2 | 7/2001 |

OTHER PUBLICATIONS

European Search Report dated Apr. 19, 2010.

* cited by examiner

*Primary Examiner* — William P Watkins, III
(74) *Attorney, Agent, or Firm* — Richard M. Klein; Fay Sharpe LLP

(57) ABSTRACT

The present invention discloses cellular confinement systems (CCSs) with improved friction with infill at low normal pressure. The invention especially presents novel flaps-containing CCS that includes inter alia a plurality of elongated strips arranged in a side by side pattern, each of the strip is segmentally bonded to an adjacent strip in spaced-apart bonding areas, said bonding areas alternating between the sides of each of said strips, such that when the system is stretched across its width, the strips curl to form a web of cells confined by cell walls disposed between the bonding areas, wherein at least one of the cell walls comprises at least one flap hinged to the wall and friction between the walls and the infill material increases.

13 Claims, 13 Drawing Sheets

B 144
141
143
142

144
141
143
1421

144
141
143
1422

CELLULAR CONFINEMENT SYSTEM

CROSS-REFERENCE TO RELATED APPLICATIONS

This is a National Phase Filing Under 35 U.S.C. 371, of International Application No. PCT/IL06/001486, filed Dec. 26, 2006, which claims the benefit of priority of U.S. Provisional Patent Application Ser. No. 60/754,303, filed Dec. 29, 2005, both of which are incorporated herein by reference.

FIELD OF THE INVENTION

The present invention generally relates to CCS with improved friction with infill at low normal pressure, especially to flaps-containing CCS.

BACKGROUND OF THE INVENTION

The present disclosure relates to plastic reinforcing articles. Strips and cellular confinement systems (CCSs) are made from polymer compositions optimized for use in geotechnical application. In many applications, the reinforcement is provided with minimal friction and normal stresses with the soil or alike. The result is limited reinforcement, and high level of undesired deformation in the strip itself and between it and the confined soil.

Plastic articles, reinforcing geotechnical-reinforced materials (GRMs), especially CCSs, are used to increase the load bearing capacity, stability and erosion resistance of GRMs which are supported by the CCSs.

CCSs comprise a plurality of high density polyethylene (HDPE) or medium density polyethylene (MDPE) strips in a characteristic honeycomb-like three-dimensional system. The strips are welded to each other at discrete locations to achieve this system. Geotechnical materials can be reinforced, confined and stabilized within or by CCSs. The surfaces of the CCS are sometimes embossed to increase friction with GRM and decrease relative movement between CCS and GRM.

The mechanical properties of GRM-filled CCSs are a composite phenomenon wherein the stiffness and rigidity is provided by the pressed infill (the GRM) and the plastic CCS cell walls provide mechanical continuity and dynamic load bearing. The normal stress applied by GRM on CCS walls, is the sum of hydrostatic pressure provided by GRM height and the compression of the GRM. The normal stress is responsible for the load bearing of the CCS wall. The higher the normal stress, the better the friction between the CCS wall and GRM. Anytime the load transfer between these two components is breached, due to cell wall creep, rupture or irreversible deformation, the filled CCSs lose their integrity and cannot provide the required structural strength, dimensional stability and stiffness. Moreover, in shallow GRMs and close to surface of the geotechnical material layer, wherein normal stress of GRM on CCS walls is low or sometimes approximately zero, relative low forces cause deformations that harm the integrity, leading to structural failure, erosion of GRM and finally disintegration of the CCS-GRM composite system. The combination of shallow GRMS and slope, has further negative effects, since compaction of GRM into CCS cells, is difficult in slopes.

The term "HDPE" refers hereinafter to a polyethylene characterized by density of greater than 0.940 g/cm$^3$. The term medium density polyethylene (MDPE) refers to a polyethylene characterized by density of greater than 0.925 g/cm$^3$ to 0.940 g/cm$^3$.

Current commercially available CCSs are generally made solely from HDPE or MDPE. CCS cell walls made from HDPE are stiff in the vertical direction, they maintain some flexibility in the horizontal direction, they are dimensionally stable, resist creep relatively well, and have sufficient stiffness when the cells are still empty and GRM is then provided, generally by dumping the GRM onto the CCS, then packing the cells within the CCS. If the CCS wall is too flexible, it will collapse during installation in the field, especially during the filling and condensing of GRM in the CCS cells. However, HDPE is relatively rigid; it has a 1% secant flexural modulus according to ASTM D790 of about 950 megapascals (MPa). The GRM is filled into the CCS, and compacted by mechanical press or alike. The composite system comprising the CCS and the compressed GRM inside, behaves as a structural unit, when loaded, vibrated or deformed. The friction between the CCS walls and the GRM is the load bearing mechanism and is a key property in the CCS long term integrity and functionality.

Usually, when a geotechnical construction is provided based on CCS and GRM, the uppermost layers, those that are on the surface down to about 1 meter, are most subjected to erosion due to the lowest normal pressure and highest rain and wind erosion, combined with vibrations, human activity and extreme climate conditions. Normal pressure is defined hereinafter as the sum of hydrostatic pressure of GRM plus compaction pressure.

Flat or embossed CCS provides relatively good cohesion and friction with GRM. Usually, when a flat HDPE strip having a thickness of 1 to 1.2 mm is in contact with shallow GRM, such as sand or graded crushed stone that provides relative moderate-low normal pressure in the range of 0.05 to 0.4 Atmosphere, the deformation created in the strip during pullout test is less than 1.2 mm for every 1 meter embedded length. This level of deformation is low enough to guarantee dimensional stability of GRM filled CCS comprising smooth or embossed walls.

The major problem of CCSs is the poor drainage between cells and the limited volume in cell so that plants grow poorly in CCS. In order to solve these important issues, CCS comprising apertures in walls are commercially available and also described in the patent literature, e.g., U.S. Pat. No. 6,395,372 which discloses a perforated cellular confinement system. Typical perforated CCS comprises about 10 to 15% of walls surface area occupied by perforation. The perforation lowers the stiffness of the CCS, so that higher deformations are observed, especially at low normal pressures or stresses. For example, a flat HDPE strip having thickness of 1 to 1.2 mm, perforated by 10 mm diameter circular apertures at 10 to 15% of its surface area, in contact with GRM, such as sand or graded crushed stone that provides relative moderate-low normal pressure, in the range of 0.05 to 0.6 Atmosphere, has a deformation created in the strip during the pullout test of about 3 to 8 mm for every 1 meter length. This level of deformation is relatively high, and it is not possible to guarantee dimensional stability of the perforated CCS-GRM composite system s.

It is thus a long felt need to provide perforated CCS with improved friction with GRM at low normal pressure in the range of about 0.05 to 0.6 Atmosphere ospheres, and with lower tendency to deform under loads provided by vibrations, human activity, erosion and drainage. The improved CCS are especially useful for confinement and reinforcement of GRM in the uppermost layers in the geotechnical system, wherein normal stresses on CCS wall are low or even zero.

SUMMARY OF THE INVENTION

It is one object of the present invention to disclose a cellular confinement system comprising a plurality of elongated strips arranged in a side by side pattern, each of the strip is segmentally bonded to an adjacent strip in spaced-apart bonding areas, the bonding areas alternating between the sides of each of the strips, such that when the system is stretched across its width, the strips curl to form a web of cells confined by cell walls disposed between the bonding areas; wherein at least one of the cell walls comprises at least one flap hinged to the wall.

It is another object of the present invention to disclose a CCS as defined above, wherein at least a portion of the flaps are welded, sewed or otherwise bonds to the wall; and/or wherein at least a portion of the flaps are made by incisioning of the wall.

It is another object of the present invention to disclose a CCS as defined above, wherein at least a portion of the strips forms a rough (embossed) wall and/or wherein at least a portion of the strips forms a perforated wall.

It is another object of the present invention to disclose a CCS as defined above, wherein each of the walls is characterized by a L*H plane (1); wherein at least a portion of the strips comprises one or more incisions (3) in at least one of such cell or any number of cells thereof; the incisions, when the cells are filled in by GRM, enabling protrusion of at least one flap being defined by a $L_f$*$H_f$ plane (2); the flap is free to rotate around at least one rotating axis (4) on the plane.

It is another object of the present invention to disclose a CCS as defined above, wherein one or more incisions in the L*H plane form a polygonal pattern, a curved pattern or a combination thereof; wherein one or more incisions are either continuous, spaced or any combination thereof; and/or wherein at least a portion of the incisions forms a filamentous filament-like texture.

It is another object of the present invention to disclose a CCS as defined above, wherein at least a portion of the incisions forms a sinusoidal pattern on the $L_f$*$H_f$ plane; wherein $L_f<L$ and/or wherein $L_f \geqq L$.

It is another object of the present invention to disclose a CCS as defined above, wherein the incision is characterized by the dimensions of $L_i$ and $H_i$ being parallel to the L*H plane, especially, yet not exclusively wherein the CCS including sinusoidal lines adjacent to the rim of the flaps, such that Li*Hi=0.

It is another object of the present invention to disclose a CCS as defined above, wherein the at least one flap is of a protuberant behavior and adapted to spontaneously extend from its wall when the structure is stretched across its width.

It is another object of the present invention to disclose a CCS as defined above, wherein the at least one flap is of a protuberant behavior and adapted to extend from its wall only when GRM condition is changed up to a predetermined measure.

It is another object of the present invention to disclose a CCS as defined above, wherein the at least one flap is adapted to extend from its wall only when (i) a pressure gradient higher a first predetermined measure is provided across the wall especially due to compaction after filling, (ii) a normal stress lower a second predetermined measure is provided or a combination of the two; especially wherein the first and second predetermined measures are in the range of about 0.05 to about 0.6 Atmosphere.

It is another object of the present invention to disclose a CCS as defined above, wherein at least one incision is characterized by dimensions of $L_i$ and $H_i$ such as $H_i \geqq H_f$; wherein at least one incision is characterized by dimensions of $L_i$ and $H_i$ such as $L_i \geqq L_f$; wherein at least one incision is characterized by dimensions of $L_i$ and $H_i$ such as $L_i<L_f$; wherein at least one incision is characterized by dimensions of $L_i$ and $H_i$ such as $H_i<H_f$; and/or wherein $L_{gap}=L-\Sigma L_i-\Sigma L_f$ and $H_{gap}=\Sigma H_i-\Sigma H_f$.

It is another object of the present invention to disclose a CCS as defined above, wherein the size of $L_{gap}$ and $H_{gap}$ is defined according to a predetermined material strength, such that the incisions and flaps do not weaken the resistance of the system to stretching and tearing of the wall, relative to perforated strip having about same percentage of perforation.

It is another object of the present invention to disclose a CCS as defined above, wherein $L_{gap}$*$H_{gap}$ is from about 30% to 95% of the cell wall area L*H; wherein $L_f$*$H_f$ is from about 0.04 $cm^2$ to 21 $cm^2$; wherein $L_i$*$H_i$ is from about 0.04 $cm^2$ to 21 $cm^2$; and/or wherein L*H is from about 10 $cm^2$ and 4,000 $cm^2$ of the cell wall area L*H.

It is another object of the present invention to disclose a CCS including inter alia a plurality of elongated strips arranged in a side by side pattern adapted to be stretched in width to form a web of cells, the strips are bonded to an adjacent strip in interconnected segments in spaced-apart bonding areas; wherein at least a portion of the cells further comprises at least one flap immobilized to adjacent welding or otherwise connecting segments.

It is another object of the present invention to disclose a method for minimizing the relative displacement between cellular confinement system (CCS) and geotechnical reinforced material (GRM) infilling the same by creating an anchoring system extending from the CCS's walls and thus creating an interlocking system between the CCS and its GRM. The method including inter alia steps selected from (i) obtaining a cellular confinement system including inter alia a plurality of elongated strips arranged in a side by side pattern, each of the strip is segmentally bonded to an adjacent strip in spaced-apart bonding areas, the bonding areas alternating between the sides of each of the strips, such that when the structure is stretched across its width, the strips curl to form a web of cells confined by cell walls disposed between the bonding areas; and (ii), at each of the cell walls, providing at least one flap hinged to the wall, formed by at least one incision in the wall.

It is another object of the present invention to disclose a method as defined above, wherein each of the walls is characterized by a L*H plane (1). At least a portion of the strips comprises one or more incisions (3) in at least one of such cell or any number of cells thereof; the incisions, when the cells are filled in by compacted GRM enabling protrusion of at least one flap being defined by a $L_f$*$H_f$ plane (2); the flap is free to rotate around at least one rotating axis (4) on the plane; and, rotating the flaps around at least one rotation axis (4) on the plane such that the flap protrudes the L*H plane such as being caught in any object and minimizing the relative displacement between cellular confinement system and its infilled GRM.

It is another object of the present invention to disclose a method as defined above, additionally including inter alia steps for providing at least one perforated wall, or rough (embossed) wall.

It is another object of the present invention to disclose a method as defined above, additionally including inter alia steps of extending at least one flap from its wall only when GRM condition is changed up to a predetermined measure.

It is another object of the present invention to disclose a method as defined above, additionally including inter alia steps of extending at least one flap from its wall only when (i) a pressure gradient higher a first predetermined measure is provided across the wall, (ii) a normal stress lower a second predetermined measure is provided or a combination of the two.

It is another object of the present invention to disclose a method as defined above, including inter alia incising at least a portion of the L*H plane to form a polygonal pattern, a curved pattern or a combination thereof.

It is another object of the present invention to disclose a method as defined above, including inter alia incising at least a portion of the L*H plane to form either a continuous, spaced or any combination thereof pattern.

It is still another object of the present invention to disclose a method as defined above, including inter alia incising at least a portion of the L*H plane to form a filament-like wall texture.

It is a last object of the present invention to disclose a method as defined above, including inter alia incising at least a portion of the L*H plane such as $L_{gap=L-\Sigma Li}-\Sigma L_f$ and $H_{gap}=H-\Sigma H_i-\Sigma H_f$.

BRIEF DESCRIPTION OF THE DRAWINGS

In order to understand the invention and to see how it may be implemented in practice, several preferred embodiments will now be described, by way of non-limiting example only, with reference to the accompanying drawing, in which FIG. 1 schematically presents a schematic and out-of-scale illustration of the aforementioned stretched out cell of a with approximate position of star-like flaps in the wall of a cellular confinement system.

DETAILED DESCRIPTION OF PREFERRED EMBODIMENTS

Figure 1:
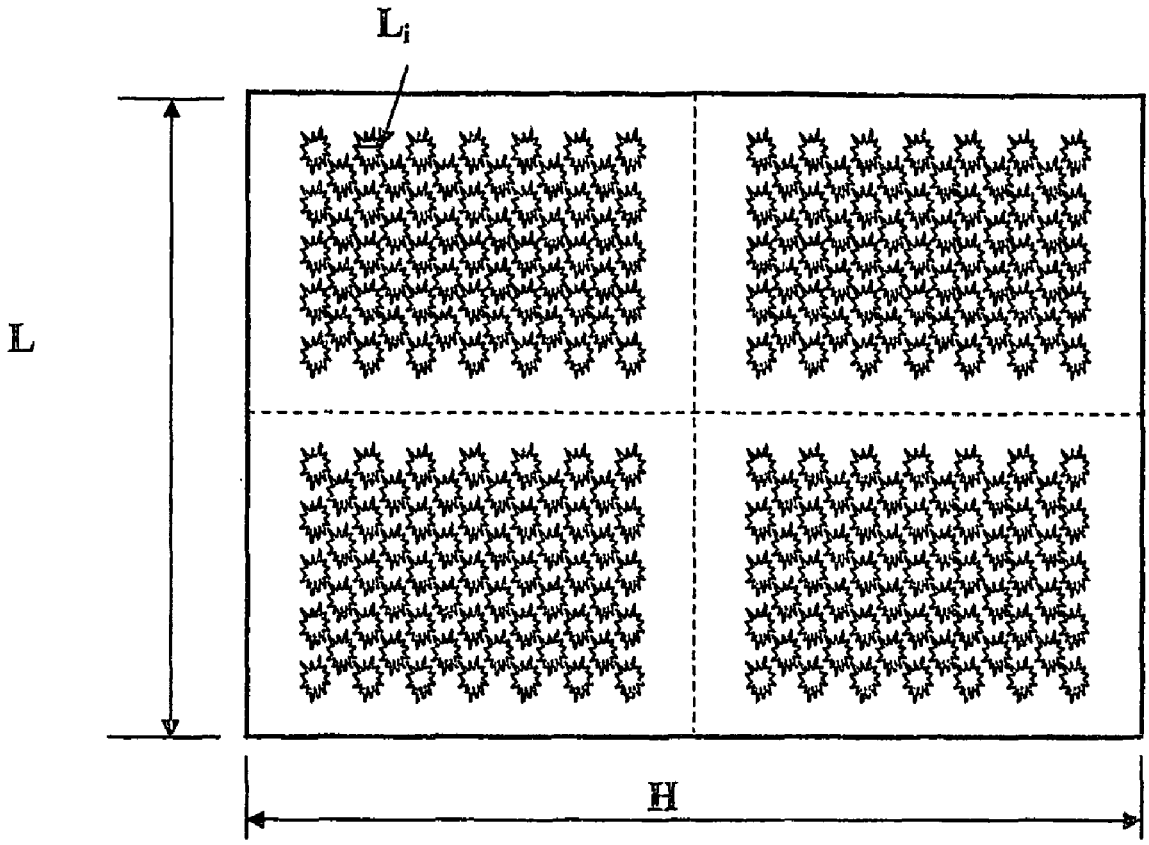

The following description is provided, so as to enable any person skilled in the art to make use of the invention and sets forth the best modes contemplated by the inventor of carrying out this invention. Various modifications, however, will remain apparent to those skilled in the art, since the generic principles of the present invention have been defined specifically to provide a cellular confinement system having a minimal relative displacement between its infill (GRM) after construction, by increasing the friction between the cellular confinement system and the GRM.

The terms 'cellular confinement systems' or CCS refer hereinafter to a plastic three dimensional honey-comb like structure for GEM-reinforcing CCS is used to increase the load bearing capacity, stability and erosion resistance of geotechnical reinforced materials. CCSs typically comprise of an array or web of cells, wherein CCS' strips are structuring cell's walls when CCS is starched and deployed.

The terms 'geotechnical reinforced material' or GRM, refers hereinafter to infill used in CCSs. The GRM may be a local soil, but usually is a particulate matter characterized by good compaction, good friction with CCSs and cost effective price. GRMs are selected for example from soil, rock, sand, stone, peat, wastes, clay, sand, concrete, crushed stones and rocks, crushed concrete fill, aggregate, industrial ash and other earth materials.

The term 'normal stress' refers hereinafter to the sum of hydrostatic pressure provided by GRM height and the compression of the GRM, applied onto CCS wall.

The term 'flap' refers hereinafter to any partially separated plane protruding from a strip or a wall plane of a CCS, improving the CCS' friction with GRM at low normal pressure, especially, yet not exclusively, in the range of about 0.05 to 0.6 Atmosphere. It is well within in the scope of the invention wherein that flaps are maintained in their non-protruding configuration during production, transportation and assembly. Flaps align themselves in the protruding configuration when a pressure gradient develops across the CCS' wall during filling and compaction of GRM in the CCS cells. Flaps may be anchored, e.g., welded or glued or sewed or riveted to the CCS by a means of one, two or more connections.

The term 'filament-like' fiber refers hereinafter to a thin threadlike texture, e.g., filaments having diameter lower than about 1 mm.

The terms 'about' and 'approximately' refer hereinafter to a tolerance of ±20% of the defined measurement The terms 'rough' or 'embossed' refers hereinafter to the texture of the CCS wall that comprises means that increases friction between confine GRM and CCS wall.

The term 'hinged' refers hereinafter to the rotation of the flap around its rotating axis The term 'Normal Stress' refers hereinafter to constant and uniform stress applied onto CCS wall by GRM at 90 degrees to the upper layer of GRM as provided in ASTM D-6706.

The term 'vectorially resolved' refers hereinafter to the calculation of the pull out force or resistance of a system's strip or web with forces acting upon it along at least two axes selected from the 'X', 'Y' and 'Z' axes.

The term 'Low Pressure Flaps' (LPFs) refers hereinafter to flaps, which extend into the substrate at pressure gradient less than approximately 0.05 Atmosphere.

The term 'Medium Pressure Flaps' (MPFs) refers hereinafter to flaps which extend into the substrate at hydrostatic pressure gradient less than approximately 0.1 Atmosphere.

The term 'High Pressure Flaps' (HPFs) refer hereinafter to flaps which extend into the substrate at hydrostatic pressure gradient less than approximately 0.6 Atmosphere.

The term 'Protruberant Behavior' refers hereinafter to the tendency of flaps to extend or tilt into areas of the cellular confinement system with respectively lower normal pressure, e.g., to the less-compressed GRM and/or in case of pressure gradient between the two side of strip, to the direction of area with lower relative pressure.

Reference is now made to FIG. 1, presenting a schematic and generalized illustration of the aforementioned stretched out CCS with approximate position of star-like flaps in the cell wall. The letter L denotes the horizontal dimension of the cell wall and H is the vertical dimension of the same, the length, $L_i$, of the incision is between about 2 mm and about 45 mm, with an optimal size of approximately about 12 mm. The incisions are approximately arranged in the pattern shown in FIG. 1. This pattern allows for optimum open area for stone infill interlock, while still maintaining sufficient wall rigidity for construction site infilling.

This flaps-containing system is especially advantageous in CCS applied near the surface, in slopes or flooded area, in CCS exposed to, vibrational perturbations at or close to the surface GRM, due to minor seismic events or highway traffic. The system is also useful in cases where GRM comprises non-compressed or weakly compressed GRM, such as peat and the like.

The present invention discloses a CCS including inter alia a plurality of elongated strips arranged in a side by side pattern. Each of the strips is segmentally bonded to an adjacent strip in spaced-apart bonding areas. The bonding areas alternating between the sides of each of the strips, such that when the CCS is stretched across its width, the strips curl to form a web of cells confined by cell walls disposed between the bonding areas. Possibly, at least a portion of the strips forms rough walls or are perforated.

It is also in the scope of the invention, wherein the walls are characterized by a L*H plane (1). At least a portion of the strips comprises one or more incisions (3) in at least one of such cell or any number of cells thereof. The incisions, when the cells are filled in by GRM, enabling protrusion of at least one flap being defined by a $L_f$*$H_f$ plane; $L_f$ represents the length of the flap plane; $H_f$ represents the height of the flap plane (2). The flap is free to rotate around at least one rotating axis (4) on the plane.

Figure 2:
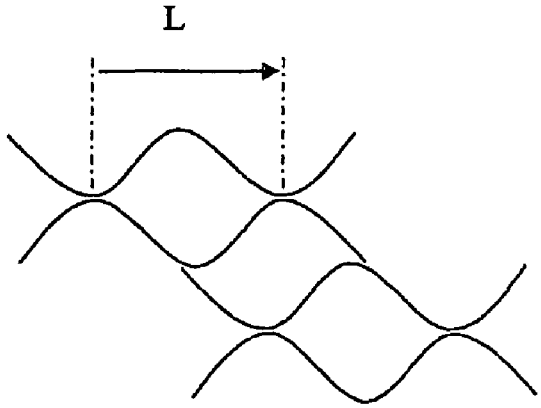
FIG. 2 schematically presents a side view of a cell of a cellular confinement system.

Reference is now made to FIG. 2, schematically presenting a side view of cells, wherein L is the cell length dimension.

Embodiments of the cellular confinement system of the present invention may be effective in establishing multidirectional frictional forces, at, close or near to the GRM surface, so as to hinder and resist GRM movements and irreversible deformation in CCS walls that leads to loss of friction between CCS and GRM where normal stress is low. The CCS itself may change it's strength properties with time, due to thermal, UV light, chemical or mechanical damage. It is clear that a CCS, used in the construction of such a retaining wall under such demands, must be fashioned and designed with polarity, namely the ability to hinder and resist GRM movement from more than one direction, perpendicularly, horizontally, planar and angles in between. Embodiments of such a novel polar cellular confinement system possessing ability to resist movement within the GRM in three dimensions are described, the key feature being the special disposition of the flaps which provide the three dimensional polarity.

It is according to one embodiment of the invention wherein flap incisions are pre-cut into the strips, during manufacture of the CCS, so as to induce them to unfold or protrude from the strip's plane, preferably at time the CCSs are filled in by GRM. It is another embodiment that during production, handling, storage and transportation, strips and flaps are characterized by a non-bulky two-dimensional folded form, which ensures the minimum of damage to the flaps. Once installed and filled in by GRM, at least a portion of the flaps unfold and exit from the strips' plane, as a response to pressure gradients provided by GRM during filling and compaction, and thus are characterized by a three-dimensional protruding form. Furthermore, it is a specific embodiment of the 3D form of the protruding flap that the free edge or edges of the flaps are induced to protrude into the low pressure zone of the pressure gradient, formed during GRM settlement and embedding around the strips making up the CCS.

It is another embodiment and purpose of the invention that flaps are self-aligning during initial assembly of the cellular confinement system and it's infilled GRM, and dynamically self-adjusting during changes in pressure gradients after construction.

Figure 6A:
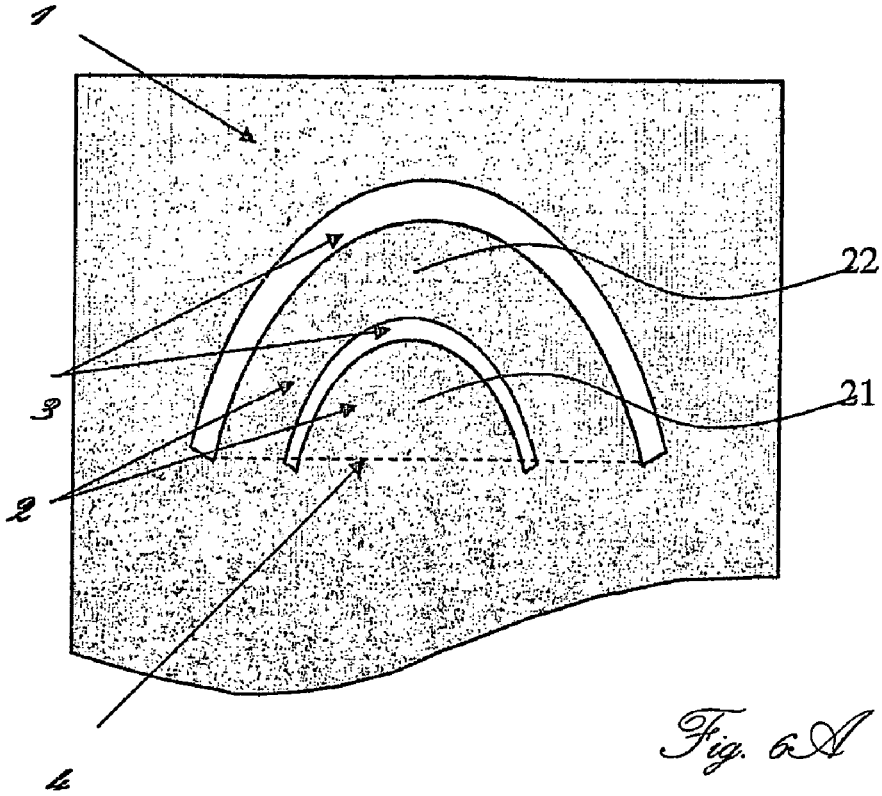
FIG. 6A schematically presents a top view of two flaps having upward semicircle contours, according to another embodiment of the invention.
Figure 6B:
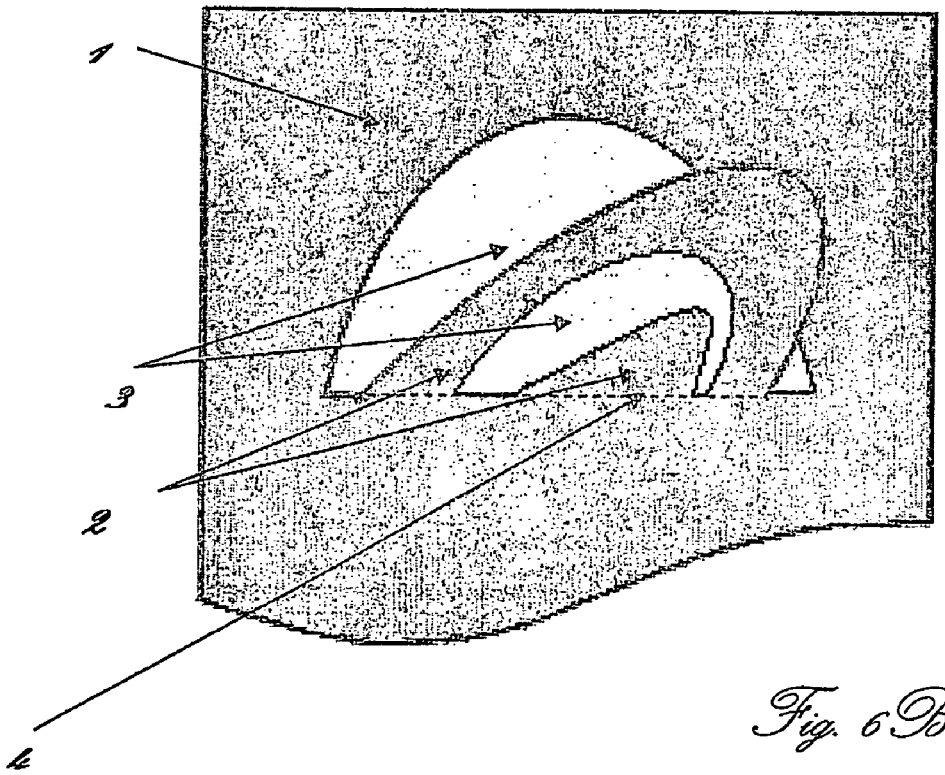
FIG. 6B schematically presents the flaps of FIG. 6A, in an extended position.
Figure 7A:
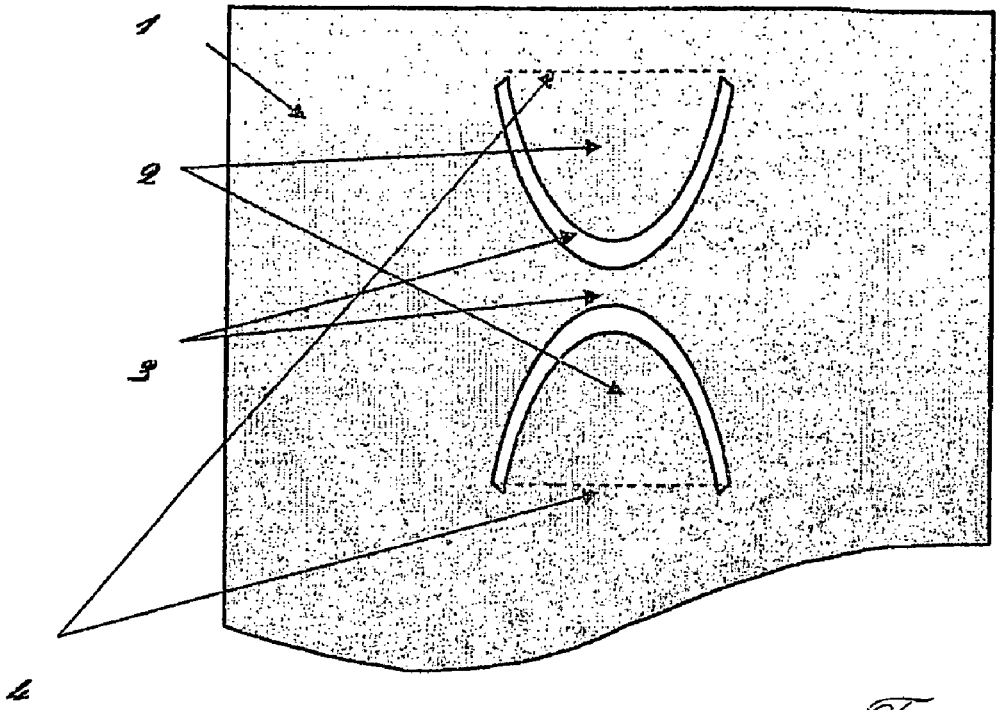
FIG. 7A schematically presents a view of two adjacent flaps having upward and downward semicircle contours, according to another embodiment of the invention.
Figure 7B:
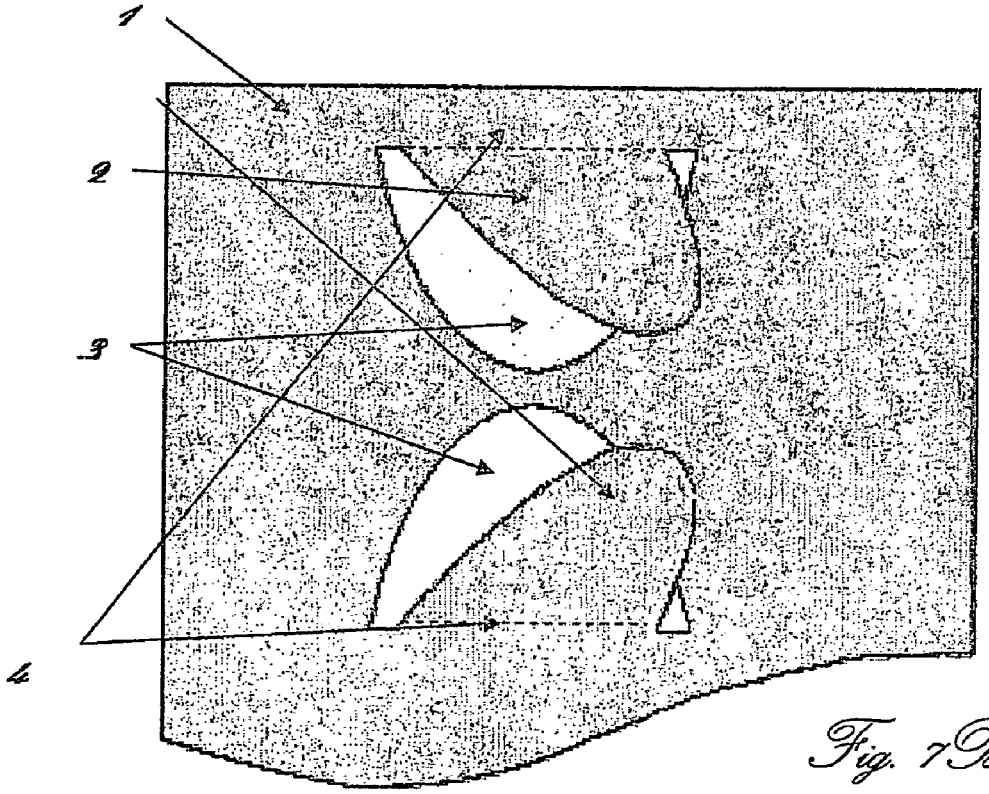
FIG. 7B schematically presents the flaps of FIG. 7A, in an extended position.
Figure 8A:
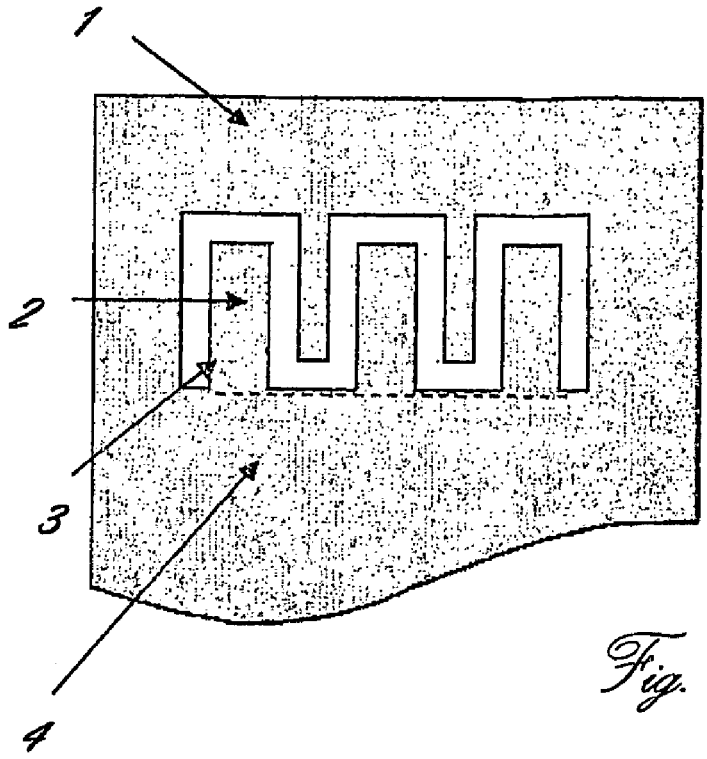
FIG. 8A schematically presents a schematic and generalized illustration of the aforementioned flap with square pattern, according to one embodiment of the invention.
Figure 8B:
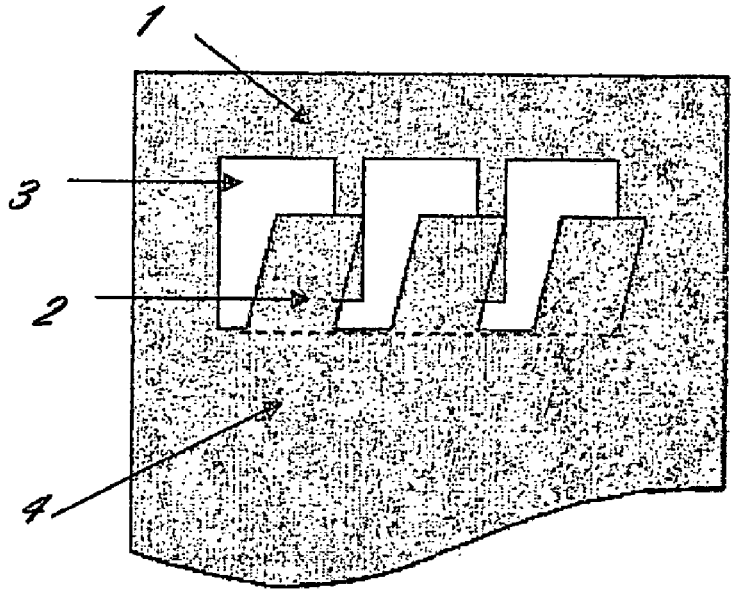
FIG. 8B schematically presents the flaps of FIG. 8A, in an extended position.
Figure 9A:
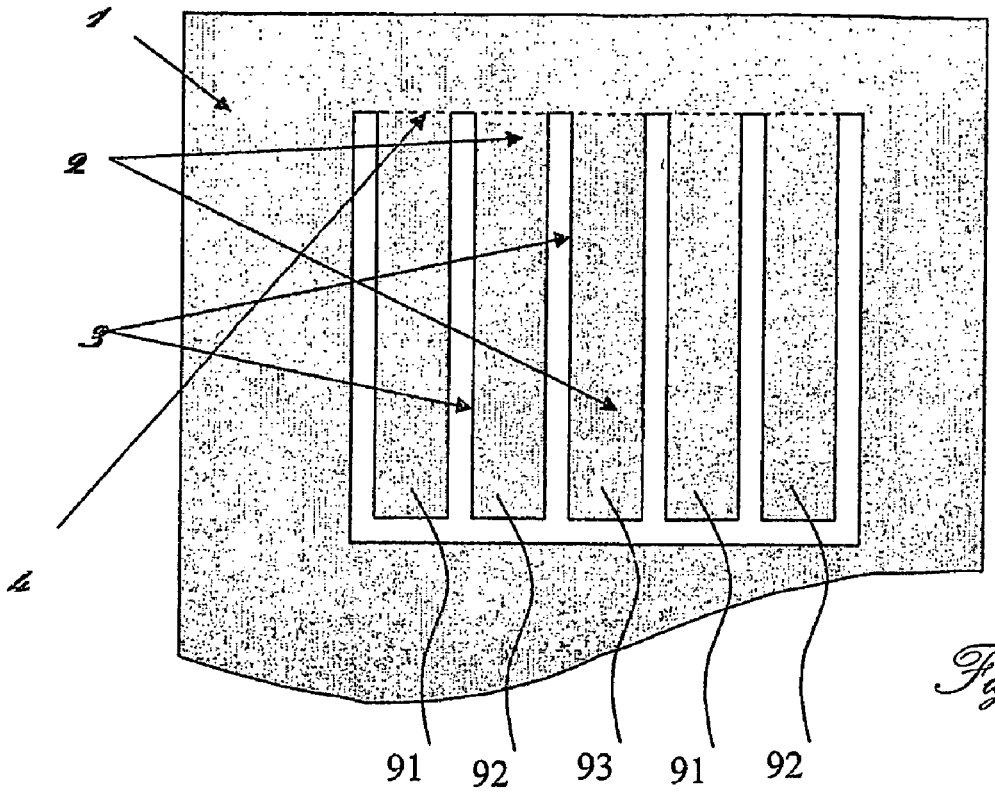
FIG. 9A schematically presents a view of flaps having a filament-like texture, according to another embodiment of the invention.
Figure 9B:
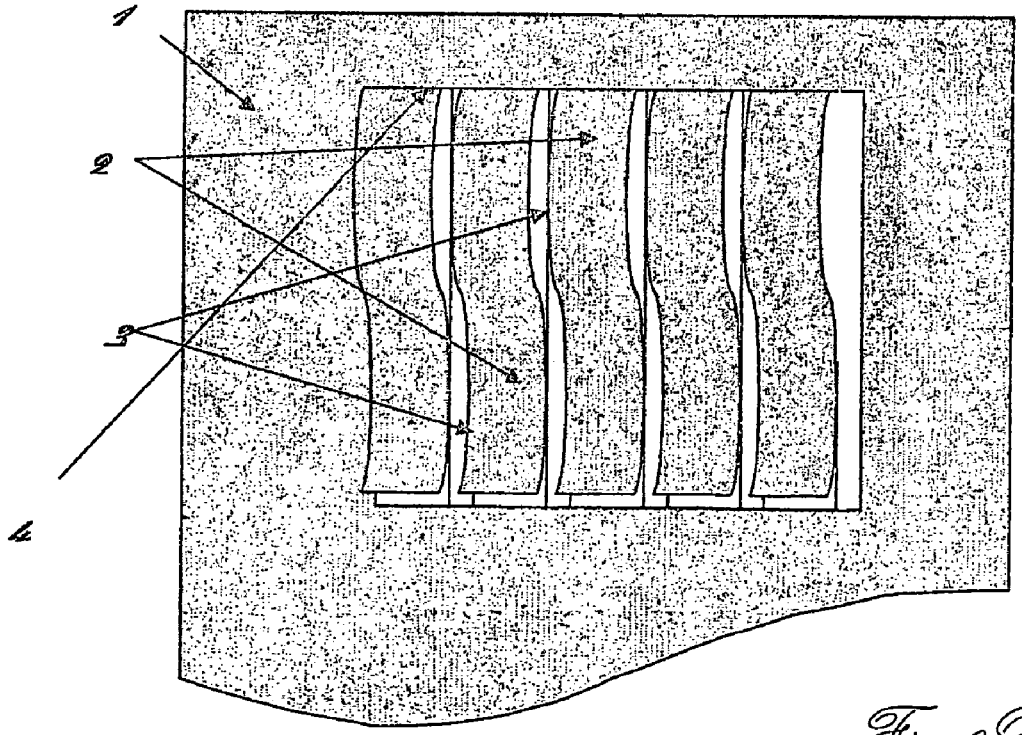
FIG. 9B schematically presents the flaps of FIG. 9A, in an extended position.
Figure 10A:
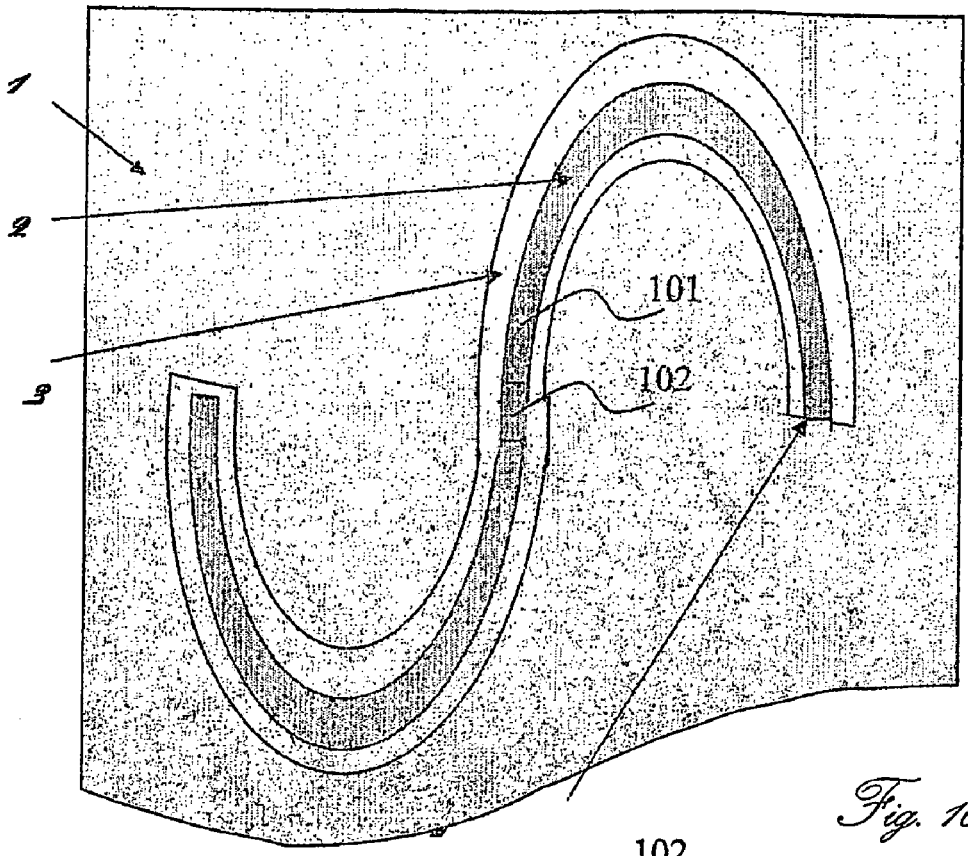
FIG. 10A schematically presents a top view of film-like flap when $L_f$ is greater than L, according to another embodiment of the invention.
Figure 10B:
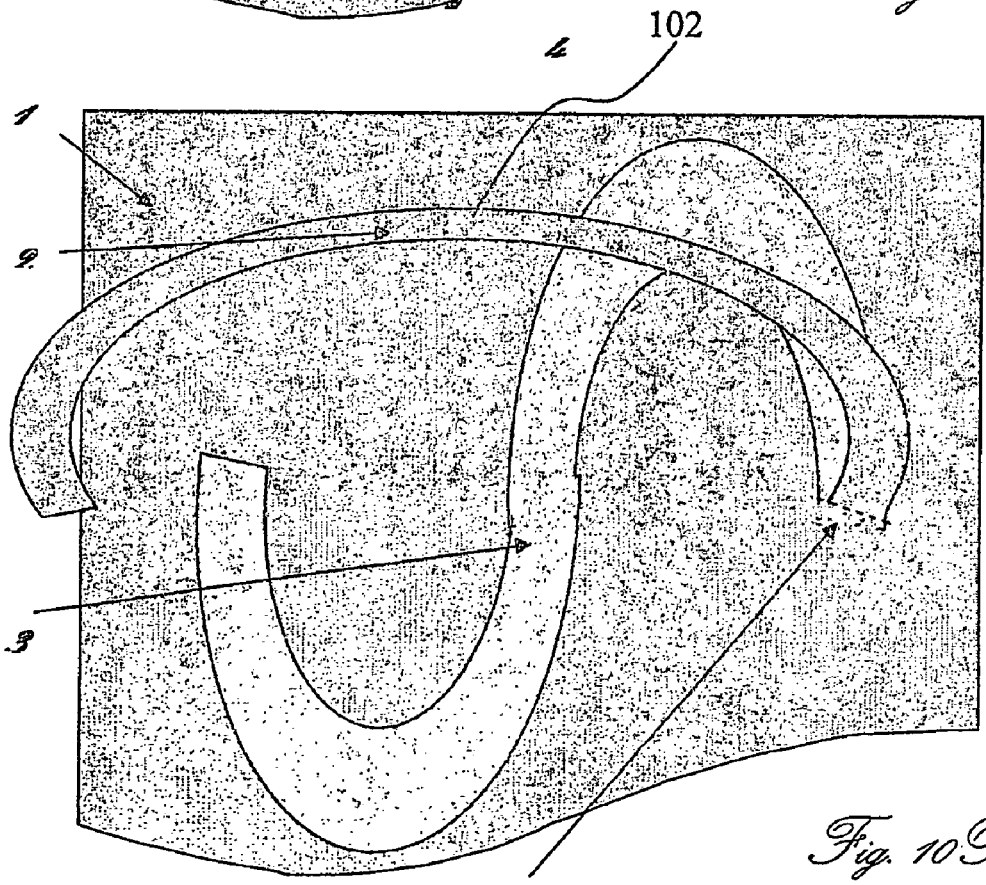
FIG. 10B schematically presents the flap of FIG. 10A, in an extended position.

According to an embodiment of the present invention, at least one incision in the L*H plane forms a polygonal pattern, a polygonal pattern as represented in FIGS. 8A, 8B, 12A, and 12B; a curved pattern as represented in FIGS. 5A, 5B, 6A, 6B, 7A and 7B; or a combination thereof as represented in FIGS. 3A, 3B, 4A and 4B; and/or to form either a continuous, spaced, e.g., regularly or not regular intervals or any combination thereof pattern; and/or to form a filament-like wall texture as represented in FIGS. 9A and 9B. FIG. 9A presents out-of-scale illustrations of LPF (91), MPF (92) and HPF (93) as protruding the side of the side of the cell containing the less-compressed GRM Reference is now made to FIG. 6*b*, presenting one illustration of the present invention, containing both an LPF (21) and a HPF (22). Reference is made to FIGS. 10A and 10B, presenting a schematic and generalized illustration of the aforementioned film-like flap, when $L_f$>L. FIG. 10*a* presents a flap including inter alia two sections, e.g., a flap composed of a first HPF section (101) and a LPF section (102).

Figure 11A:
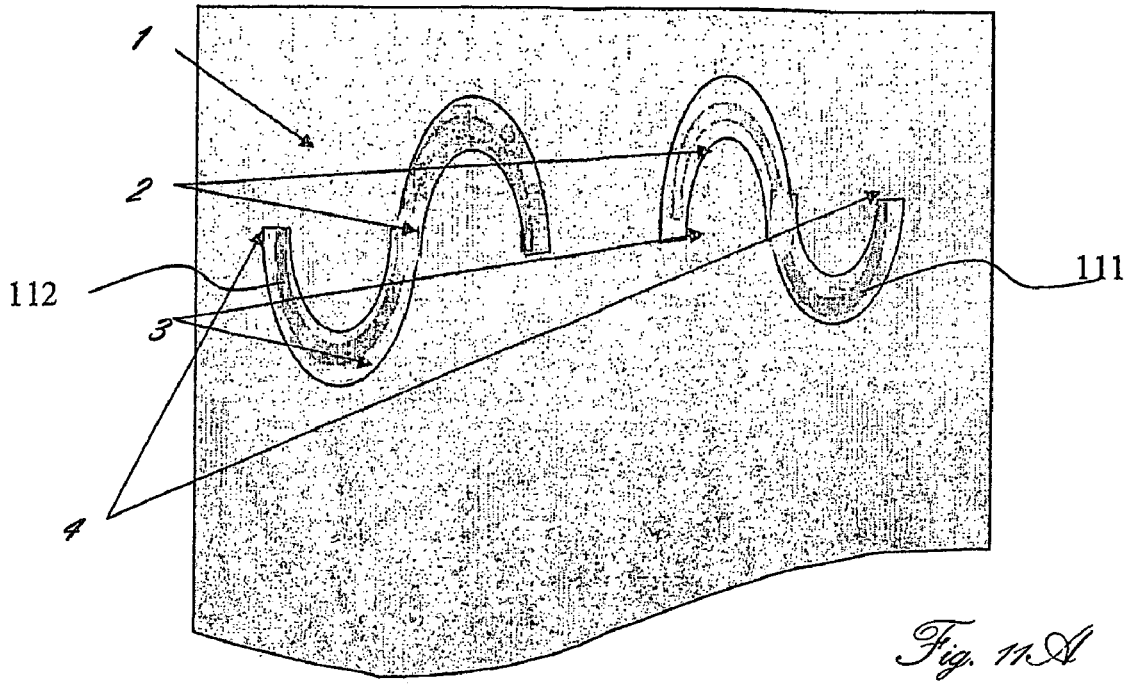
FIG. 11A schematically presents the embodiment of FIG. 10, wherein two adjacent film-like flaps are provided, here again, the flap is characterized in that the incisions have a sinusoidal shape, according to another embodiment of the invention.
Figure 11B:
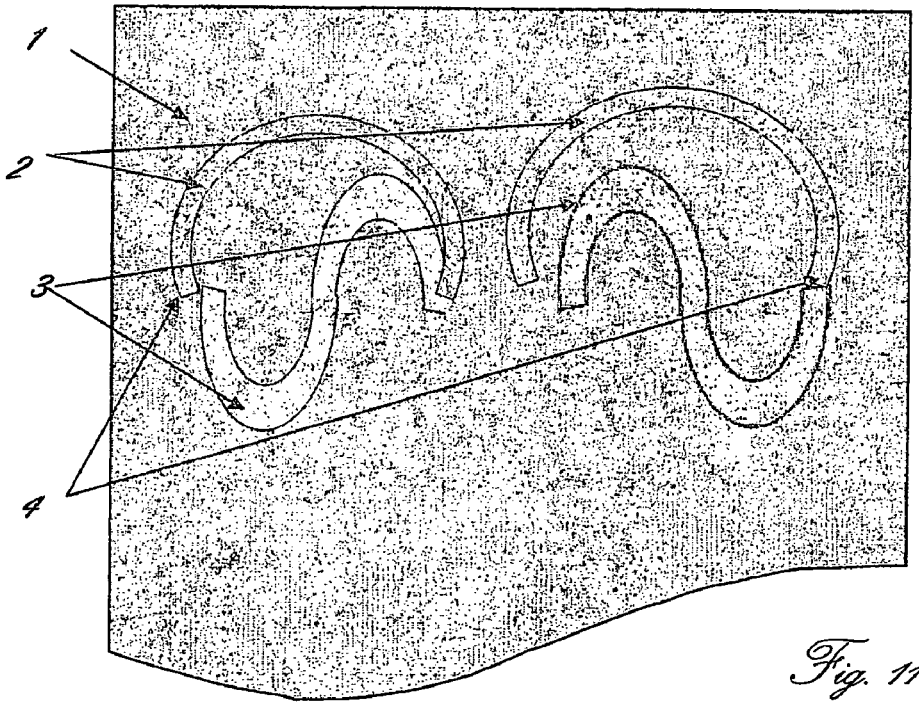
FIG. 11B schematically presents the flaps of FIG. 11A, in an extended position.

Reference is now made to FIGS. 11A and 11B, presenting a schematic and generalized illustration of the aforementioned two adjacent film-like flaps, characterized in that the incisions have a sinusoidal shape according to another embodiment of the present invention. FIG. 11A presents an out-of-scale example illustrating an LPF (111) as protruding in low pressure gradients, and a HPF (112) protruding in high pressure gradients.

Figure 3A:
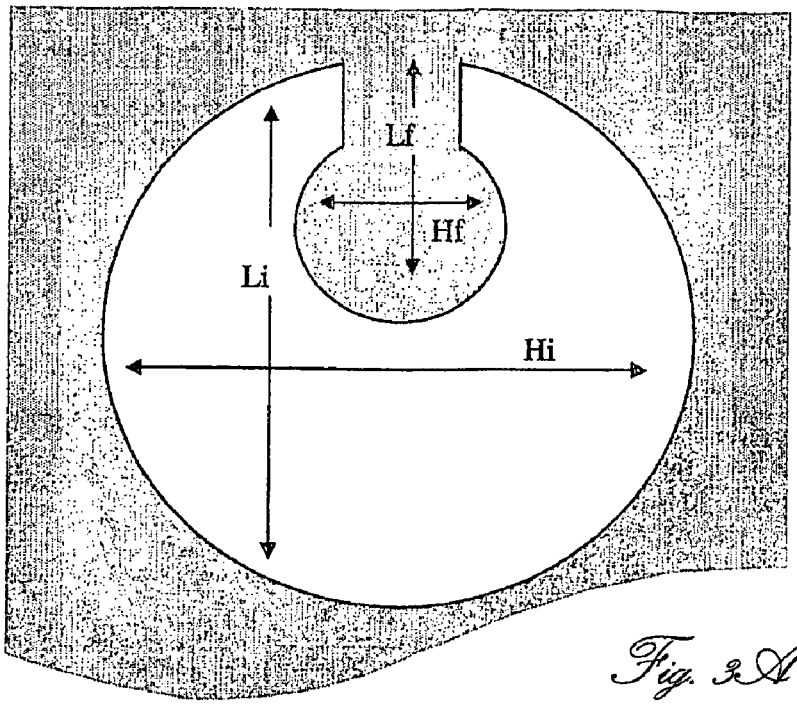
FIG. 3A schematically presents a schematic and generalized illustration of a section of the CCS's cell wall, including inter alia one incision characterized by $L_i$*$H_i$, and forming one flap characterized by $L_f$*$H_f$ plane when $L_f$ is lesser than $L_i$.
Figure 3B:
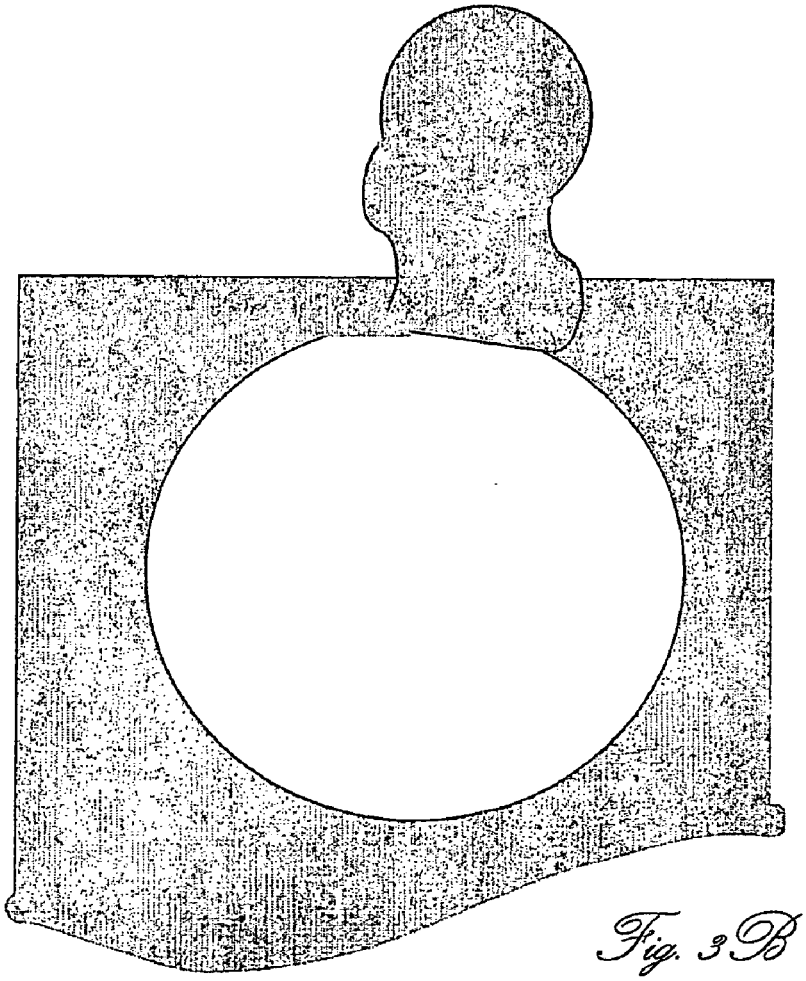
FIG. 3B schematically presents the flap of FIG. 3A, in an extended position, the extension is triggered during compaction of GRM.
Figure 4A:
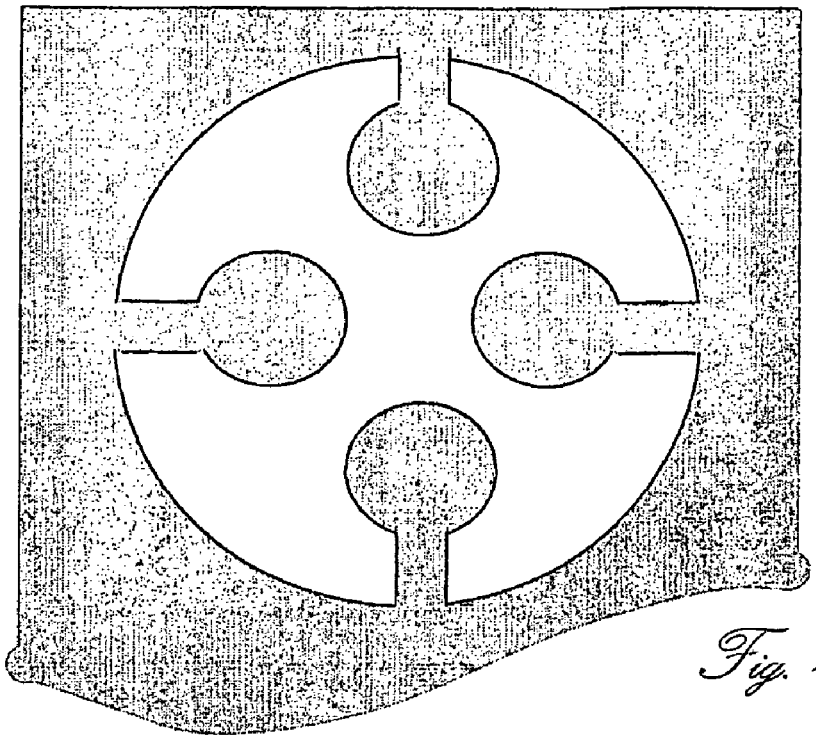
FIG. 4A schematically presents a view of four adjacent flaps when $L_f$ is lesser than $L_i$ according to another embodiment of the present invention.
Figure 4B:
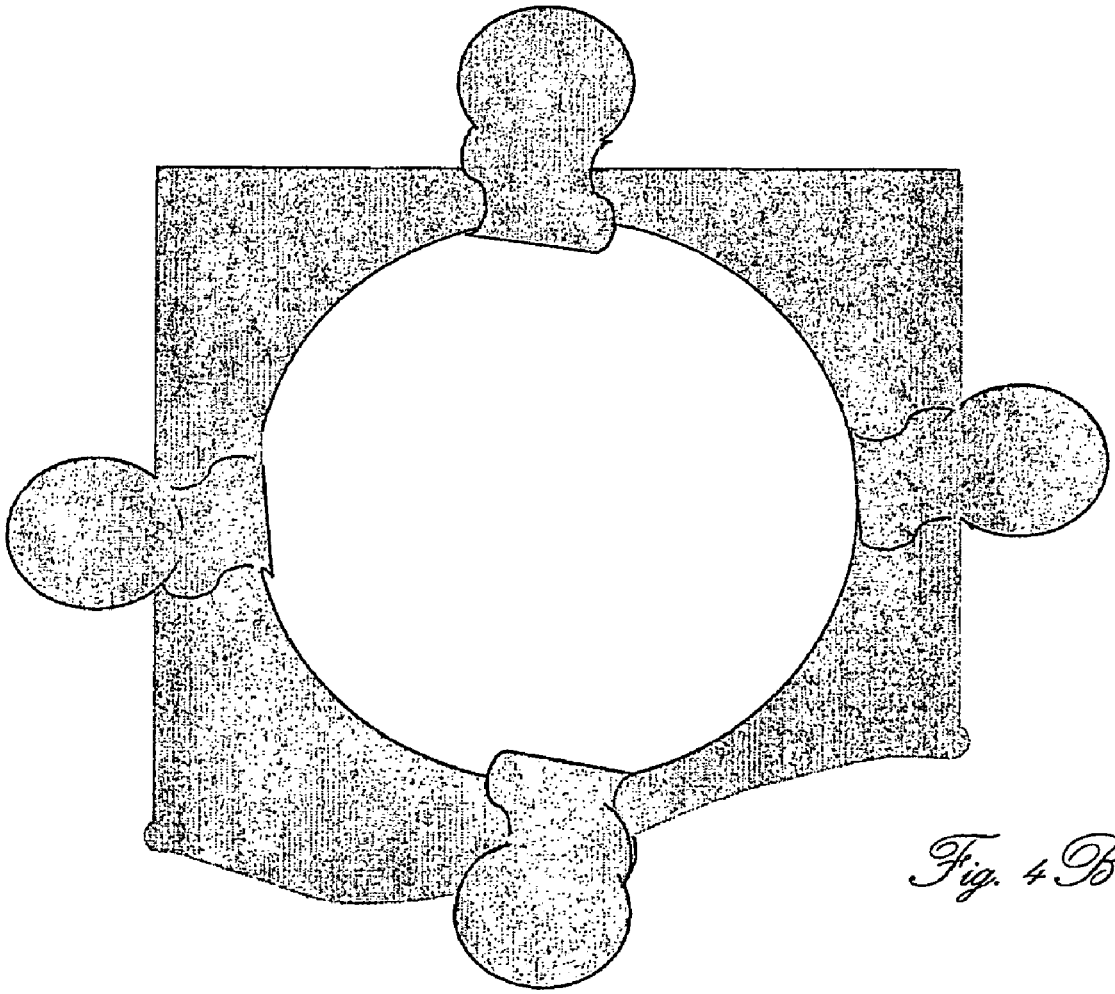
FIG. 4B schematically presents the flaps of FIG. 4A, in an extended position; in all figures below, No. 1 represents the L*H plane, No. 2 the flap, No. 3 the incision opening and No. 4 the rotating axis.
Figure 5A:
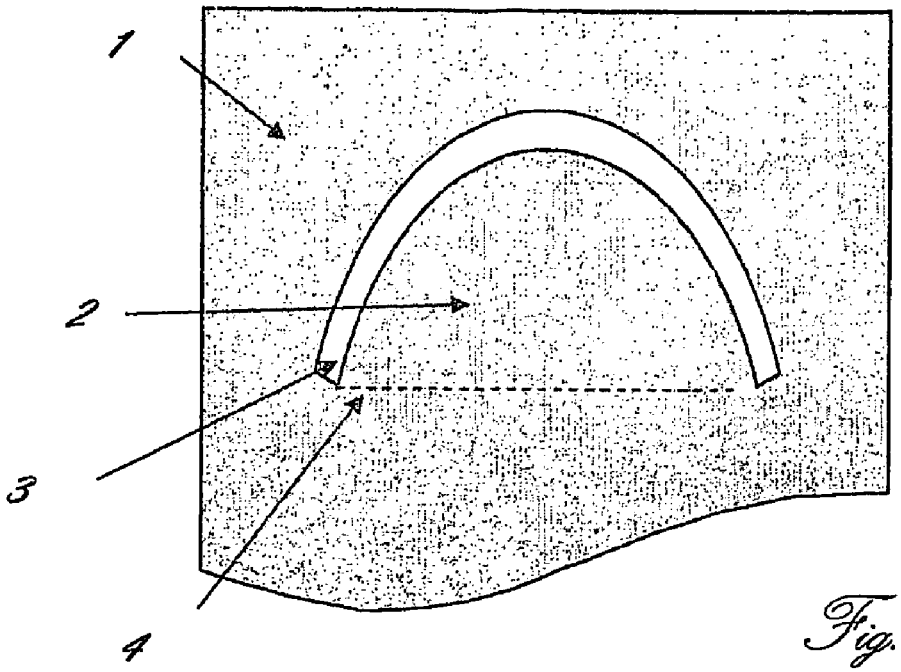
FIG. 5A schematically presents a view of a curved flap having upward semicircle contours, according to another embodiment of the invention.
Figure 5B:
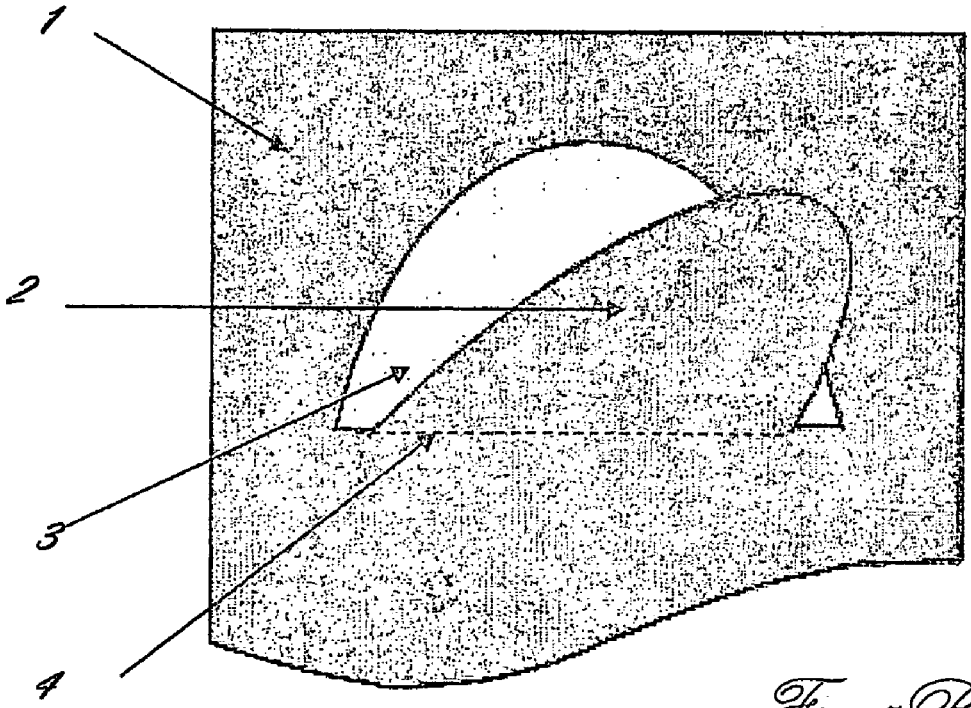
FIG. 5B schematically presents the flap of FIG. 5A, in an extended position.

The incision as defined in any of the above may be characterized by the dimensions of $L_i$ and $H_i$ being parallel to the L*H plane. The cellular confinement system comprises sinusoidal lines adjacent to the rim of the flaps, such that Li*Hi=0. The sinusoidal lines are such that by perforating the walls, the flaps spontaneously extend when the system is stretched across its width. The dimensions of $L_i$ and $H_i$ are selected in a non-limiting manner from $H_i \geqq H_f$; $L_i \geqq L_f$; $L_i < L_f$; $H_i < H_f$. It is acknowledged in this respect that $L_{gap}$ may preferably be equal to $L-\Sigma L_f$ and $H_{gap}=H-\Sigma H_i-\Sigma H_f$. The size of $L_{gap}$ and $H_{gap}$ may be defined according to a predetermined material strength. Reference is now made to FIGS. 3A and 3B, presenting a schematic and generalized illustration of a section of the cell wall, characterized by an L*H plane, including inter alia one incision characterized by $L_i*H_i$, forming one flap characterized by $L_f*H_f$ plane when $L_f$ is lesser than $L_i$.

It is in the scope of the present invention wherein the strip including inter alia an array of incisions or apertures, at least a portion of them including inter alia one flap, and further wherein those neighboring flaps are directed to various directions, e.g., each flap is rotated clockwise or counter-clock wise to direct 30°, 60° or 120° in respect to its neighboring flap, so as a multidirectional array of flaps is obtained.

It is according to one embodiment wherein the incision of the CCS wall for forming the flaps provides an aperture required for drainage of fluids.

According to another embodiment of the present invention, $L_{gap}*H_{gap}$ is from about 30% to 95% of the cell wall area L*H; $L_f*H_f$ is from about 0.04 $cm^2$ to 21 $cm^2$; $L_i*H_i$ is from about 0.04 $cm^2$ to 21 $cm^2$; and L*H is from about 10 $cm^2$ and 4,000 $cm^2$ of the cell wall area L*H.

According to another embodiment of the present invention, at least a portion of the incisions forms a sinusoidal pattern on the Lf*Hf plane. The ratio between Lf and L is selected in a non limiting manner from Lf<L and Lf≧L as illustrated in FIGS. 10A, 10B, 11A and 11B.

Figure 12A:
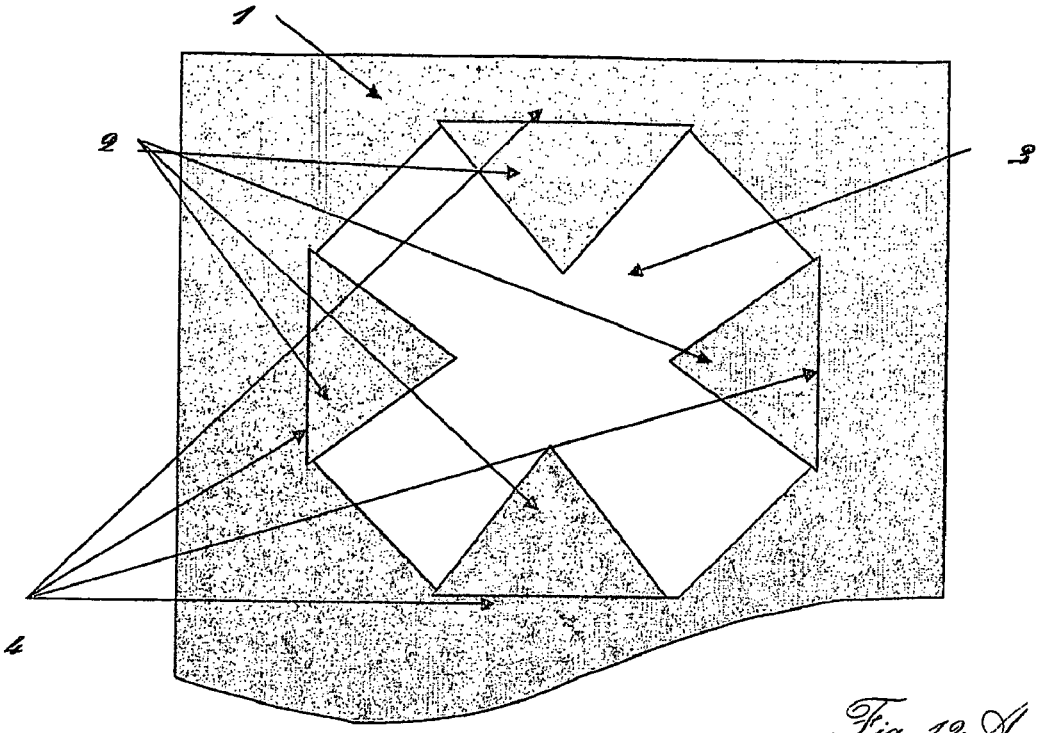
FIG. 12A schematically presents a view of four triangular flaps, according to another embodiment of the invention.
Figure 12B:
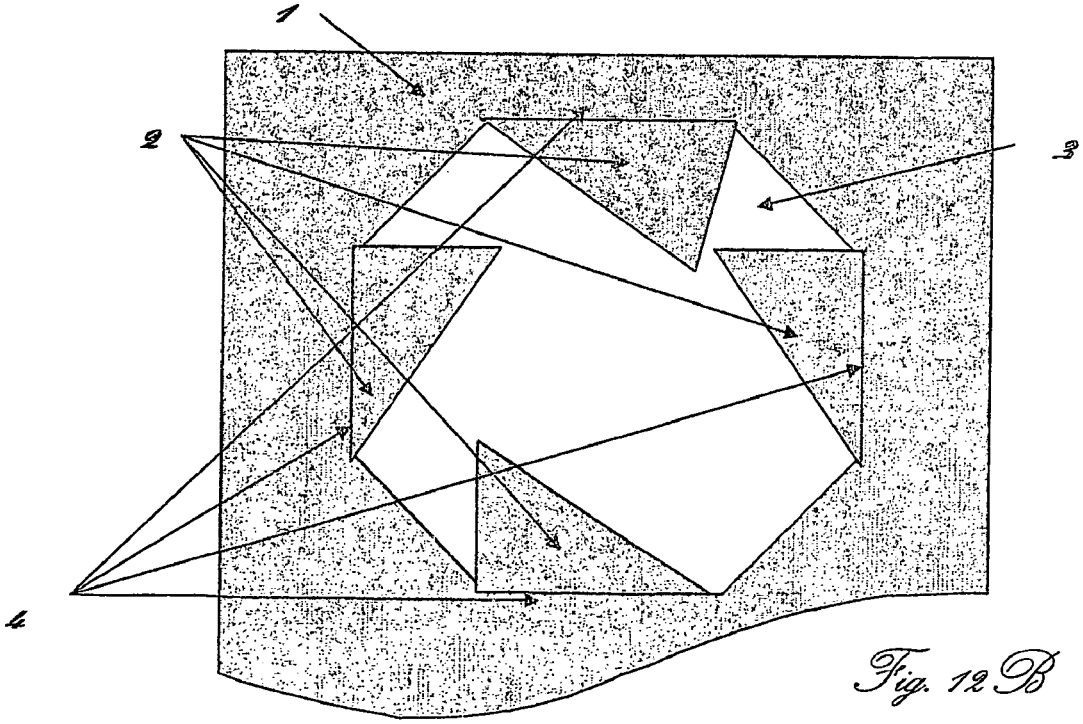
FIG. 12B schematically presents the flaps of FIG. 12A, in an extended position.

Reference is now made to FIGS. 12A and 12B, presenting a generalized and schematic illustration of four triangular flaps characterized in that the total sum of the flap area is less than the area of the aperture.

It is acknowledged in this respect, that although various flaps of different size, type and pattern were described in the figures, there are countless more possible patterns that may coexist.

It is another embodiment of the present invention wherein a CCS includes a plurality of elongated strips arranged in a side by side pattern, adapted to be stretched in width to form a web of cells. The strips are bonded together in interconnected segments in spaced-apart bonding areas. Wherein at least a portion of the cells further includes at least one flap immobilized to adjacent interconnected segments.

It is another embodiment of the present invention to provide a method including inter alia obtaining a cellular confinement system including inter alia a plurality of elongated strips arranged in a side by side pattern, segmentally bonded together in spaced-apart bonding areas, adapted to be stretched in width to form a web of cells. The strips form walls, wherein each of the walls defines an L*H plane (1) including one or more incisions (3) in at least one of such cell or any number of cells thereof, forming at least one flap characterized by $L_f*H_f$ plane (2). The flap substantially protrudes from the L*H plane as response to normal stresses during GRM filling and compaction and is free to rotate around at least one rotating axis (4) on the plane; and rotating the flap around at least one rotation axis (4) on the plane such that the flap protrudes the L*H plane.

It is another embodiment of the present invention to provide a method of incising the L*H plane to form a polygonal pattern, a curved pattern, or a combination thereof. The incisions may be either continuous, spaced, or any combination thereof. At least a portion of the incisions may form a filament-like wall texture.

It is another embodiment of the present invention to provide a method of increasing surface by forming a CCS characterized by an increased friction with GRM, and especially by increased friction in directions not parallel to L*H plane. The method including inter alia steps of obtaining a plurality of elongated strips arranged in a side by side pattern, adapted to be stretched in width to form a web of cells; the strips are bonded together in interconnected segments in spaced-apart bonding areas. At least a portion of the cells further comprise at least one flap immobilized to adjacent interconnected segments.

Polar Resistant Standard (ERS)

A major difficulty is to simulate the conditions obtaining in the field, especially at shallow GRMs whereat GRM is weakly compressed and hydrostatic pressure is low or even close to zero and at CCSs applied in slopes. At present, the existing standard and method for measuring the geosynthetic pullout resistance in soil (ASTM 6706-01) is used to compare different geosynthetics, GRM types etc. and is used as a research and development test procedure. In the standard test method ASTM 6706-01, resistance of a geosynthetic to pullout from soil is determined using a laboratory test chamber. A geosynthetic is embedded horizontally between two layers of soil, horizontal force is applied to the geosynthetic and the force required to pull the geosynthetic out of the soil is recorded. The pullout resistance is obtained by dividing the maximum load by the test specimen width. The test is performed while the sample is subjected to normal stresses which are applied to the top soil layer. A plot of maximum pullout resistance versus applied normal stress is obtained by conducting a series of such tests. The ASTM 6706-01 test method is intended as a performance test to provide the user with a set of design values for the test conditions examined. The test results are also used to provide information related to the in-soil stress-strain response of a geosynthetic under confined loading conditions.

The pullout resistance versus normal stress plot obtained from this test is a function of GRM gradation, plasticity, as-placed dry unit weight, moisture content, length and surface characteristics of the geosynthetic and other test parameters.

Therefore, results are expressed in terms of the actual test conditions. The test measures the net effect of a combination of pullout mechanisms, which may vary depending on the type of geosynthetic specimen, embedment length, relative opening size, GRM type, displacement rate, normal stress and other factors. It is important to note that ASTM 6706-1 is especially adapted to measure pullout of deeply embedded sheets, and not CCS confined at, near or close to the surface GRM. ASTM 6706-1 thus does not treat measurement of forces acting on the structures along a combination of X, Y and Z Cartesian axes, nor does it provide data for pulling strengths acting simultaneously or sequentially in various directions. ASTM 6706-1 does not provide data from situations in which the structure is embedded in a tilted fashion, along various planar angles, in the construction GRM.

ASTM 6706-01 produces data which is used in the design of deeply embedded under high normal stress conditions at geosynthetic-reinforced retaining walls, slopes and embankmnents, or in other applications where resistance of a geosynthetic to pullout under simulated similar field conditions is important. There is, however, a major drawback and disadvantage to the existing standard to our specific needs in that it merely measures the pullout force required to remove a structure along it's embedded length in a horizontal direction. It essentially supplies data for only two dimensions the machine and cross-machine directions. The test conditions are such that information is provided for pullout strengths of structures embedded at some depth and subjected to high tightening or hydrostatic normal pressures. The current standard does not yield useful data regarding the situations obtained in the field in case of using the web cell structures. In reality, structures should be resistant to movement in any axis or dimension at, close or near to the ground surface under weak tightening or low hydrostatic pressures. In the true situation, a CCS-reinforced embankment, slope or retaining wall may be acted upon by forces and stresses in three dimensions from several different directions. Such forces may come into play at different times. For example, a sloping retaining wall may have recently been stressed by an extra load due to the erection of a building on the land retained behind it. Later on, flooding may have occurred, saturating the GRM, causing expansion in all directions, followed by cycles of freezing and thawing due to the weather conditions, and then close-to-surface vibrational perturbations due to minor seismic events or highway traffic. The structure itself may change it's strength properties with time, perhaps due to biological, chemical or mechanical damage, as well as temperature fluctuations. It is clear that a structure, used in the construction of such a retaining wall under such demands must be fashioned and designed with polarity. The term 'polarity' is defined here as the ability to hinder and resist GRM movement from more than one direction, perpendicularly as well as horizontally as well as planar angles in between. For the structure to be useful in the real world it must be effectively polar at, close to or near the surface of the GRM, where hydrostatic pressure is low, thus normal pullout is easy.

Figure 13A:
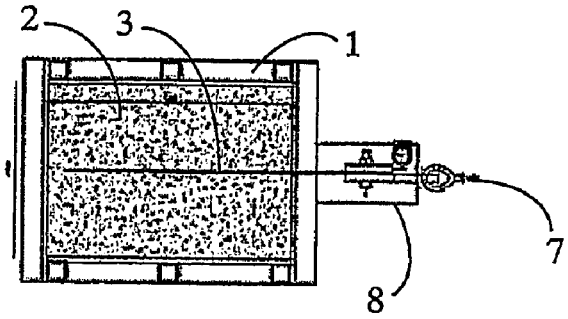
FIG. 13A schematically presents a vertical view of a Polar Resistant Standard (PRS) test chamber as defined below and according to an embodiment of the invention.
Figure 13B:
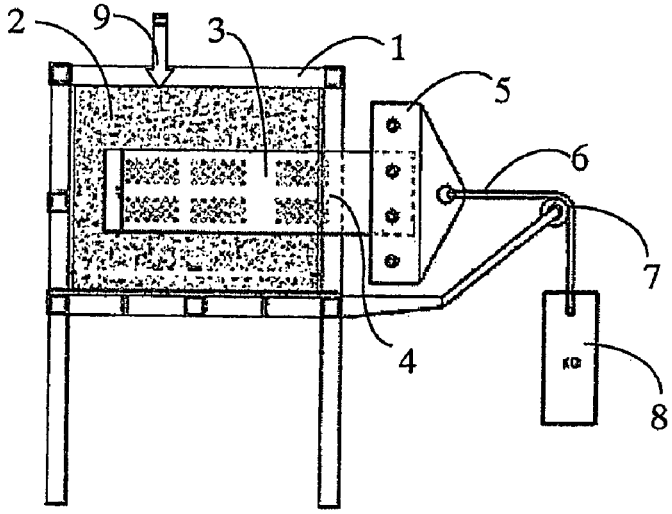
FIG. 13B schematically presents a side view of a PRS test chamber according to an embodiment of the invention; and, FIGS. 14A, 14B and 14C schematically present a cross-sectional vertical view through two layers of GRM, separated by a cellular confinement system according to one embodiment of the invention.

Reference is now made to FIG. 13, illustrating schematically a Polar Resistant Standard (PRS) test chamber according to the present invention for measuring 3D cellular confinement system pullout resistance. The PRS test chamber is especially adapted to test samples in predetermined three dimensional directions at, close or near to the surface where tightening is weak or normal stresses are low.

The PRS test chamber comprises inter alia modules as defined below: a rigid container (1), characterized by stiffness and strength to withstand the hydraulic pressures during installation and testing, including inter alia at least two mobile walls. The container is characterized by main X, Y, and Z Cartesian axes, wherein X is length, Y is width and Z height (vertical axis); a clamping device (5). The tested cellular confinement system (3) applied normal to the horizontal at an angle $\phi$, wherein $17° < \phi > 162°$, especially about 90°; a cable (6) interconnecting said clamping device (5) with a pulling mechanism (7); a load cell (8) connected to said cable (6) so as stress in cable is equal to stress on load cell; a predetermined measure of GRM (2) GRM in said rigid container (1), providing pressure against said system (3); and, optionally, a press (9), communicating with side facets of said pressed GRM (2), so that normal stresses can be controlled and adjusted to a pre-defined level in said GRM (2); embedding a CCS' cell strip or web within GRM (2); applying normal compressive stress uni-directionally through said GRM; pulling said CCS' cell, strip or web over it's entire embedded length along the at least one main Cartesian axis selected from Y, Z or any vector resolved form the parallelogram rule; and lastly, obtaining the pullout resistance (N/cm) per said CCS' cell, strip or web. The PRS test chamber hence assists in the design and testing of polar CCS, sheets or cells thereof having the ability to hinder and resist GRM movement, from more than one direction, preferably perpendicular, when the CCS or the tested CCS strip is embedded in GRM at, close to or near the surface.

It is also in the scope of the present invention wherein the PRS comprises further of sequentially pulling the said tested CCS' cell, strip or web over it's entire embedded length along said at least one main Cartesian axis selected from Y, Z or any vector resolved from the parallelogram rule. It is also in the scope of the present invention wherein said sequential order is selected from a group including inter alia said 'Z' and 'Y' Cartesian axes, thereby obtaining a vectorially resolved pullout resistance (N/cm) per said system cell, strip or web.

Another object is to disclose a method for obtaining PRS as defined above, including inter alia further of embedding said CCS' cell, strip or web, at an angle of $\alpha$ to main axis X, $\beta$ to main axis Y, and $\gamma$ to main axis Z, wherein $0° \leqq \alpha, \beta, \gamma > 90°$; pulling said CCS' cell, strip or web over it's entire length, along said angled plane; and, obtaining a pullout resistance (N/cm) per said tilted system cell, strip or web. It is also in the scope of the present invention wherein said system cell, strip or web is provided simultaneously. It is also in the scope of the present invention wherein the CCS' cell, strip or web is provided non-simultaneously.

It is according to one embodiment of the invention that the CCS' cell, strip or web is embossed. It is still according to one embodiment of the invention that the system cell, strip, strip or web is apertured or perforated. It is also according to one embodiment of the invention that the CCS cell, strip or web is flapped.

It is according to one embodiment of the invention that the hydrostatic pressure applied to CCS' cell, strip or strip under test is approximately 0.01 to 0.6 Atmospheres. It is also according to yet another embodiment of the invention wherein no external hydrostatic pressure is applied to the strip under test.

Figures 14A, 14B, 14C:
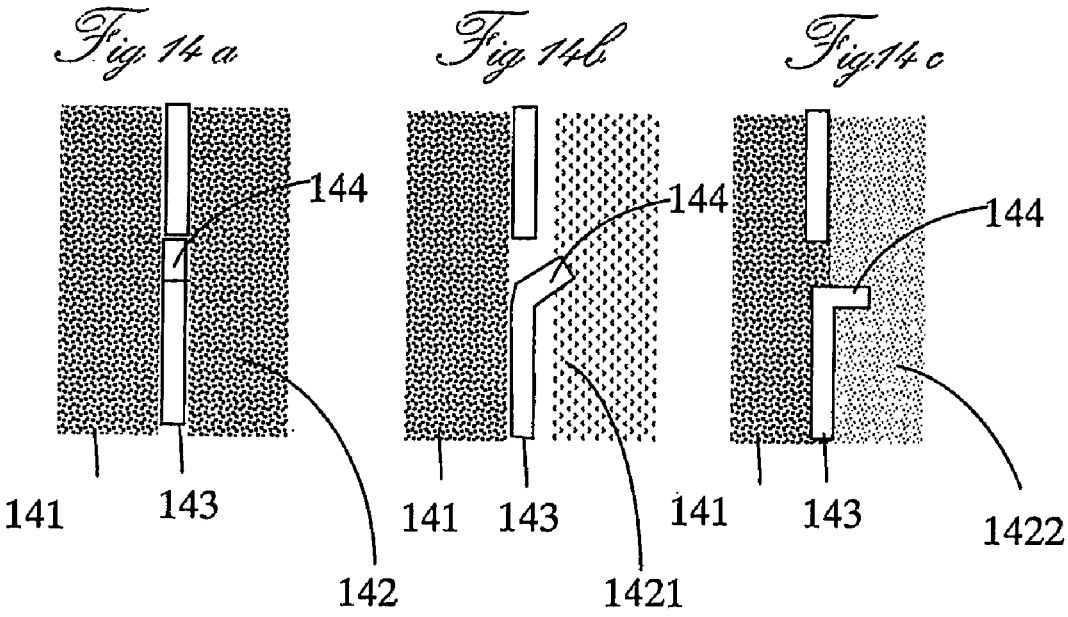

Reference is now made to FIG. 14A, presenting a cross-sectional vertical view through two layers of GRM (141) and (142), separated by cellular confinement system (143) with non-protruding flap (144) in a location of equal normal stress across the system. Here, GRMs 141 and 142 are compressed, tightened, or fastened to the same extent so as no normal stresses gradient across the system is obtained.

Reference is now made to FIG. 14B, presenting a cross-sectional vertical view through two layers of GRM (141) and (1421), separated by cellular confinement system (143) in a location where GRM of (1421) loosens moderately, and a hydrostatic pressure gradient develops across the system. The flap (144) is induced to protrude moderately, in the direction of the moderately lower hydrostatic pressure gradient of approximately 0.1 Atmosphere. Here, GRM 141 is more compressed, tightened, or fastened than 1421 so that normal pressure gradient across the system is developed.

Reference is now made to FIG. 14C, presenting a cross sectional vertical view through two layers of GRM (141) and (1422), separated by cellular confinement system (143) in a location where GRM of (1421) loosens greatly and a hydrostatic pressure gradient develops across the system. The flap (144) is induced to protrude fully, in the direction of the greatly lowered hydrostatic pressure gradient of 0.6 Atmosphere. Here, GRM 141 is highly compressed, tightened, or fastened with respect to 1422, so that high normal pressure gradient across the system is developed.

It is acknowledged in this respect and in a non-limiting manner that flaps can be defined as being suitable for a range of pressure gradients as exemplified by Low Pressure Flaps, which extend into the substrate at pressures <0.05 Atmosphere, Medium Pressure Flaps, which extend into the substrate at pressures <0.1 Atmosphere, and High Pressure Flaps, which extend into the substrate at pressures <0.5 Atmosphere. It is acknowledged in that respect that those measures can be varied to match various filed conditions.

In order to further understand the invention and to see how it may be implemented in practice, reference is now made to Tables 1 to 4.

EXAMPLES

Marlex RT K306 MDPE (manufactured by Chevron Philips™) having a density of 0.937 g/cm$^3$, was extruded at 260° C. in a single screw extruder, through a flat die and chilled on texturized metal rolls to an embossed strip having thickness of 1.2 mm. The strip was cut to 20 cm wide strips that are used as reference and named REF and represent the un-perforated strips currently available in the market.

Another set of REF strips was perforated by round punch, having 10 mm diameter, in a pattern of rows and columns, so as 15% of strip surface area was perforated. This kind of strips was named REF-P and represents the perforated strips currently available in the market.

Another set of REF strips was punched by flap forming punch, so as flaps of 10 mm arm and 6 mm hinge are formed, in a pattern of rows and columns, so as 15% of strip surface area was punched. This kind of strips was named FLAP and represents the flap-perforated strips according to the present invention.

The three kinds of strips were loaded to a PRS pullout device, and embedded in two GRMs: (a) sand having density 1.665 gr/cm$^3$; and, (b) graded crushed stone having density 2.15 gr/cm$^3$. The strip width was 20 cm and its embedded length was 50 cm.

The normal stress was set to 0.15 and 0.05 Atmosphere, in order to simulate situation in shallow GRMs and uppermost layers of geotechnical system s. The pullout resistance (load causing pullout divided by strip width) and deformation in the embedded sector (the 50 cm length) under said load were measured.

Tab. 1 describes the results of the three different strip types in sand under normal pressure of 0.15 Atmosphere. Tab. 2 describes the results of the three different strip types in graded crushed stone under normal pressure of 0.15 Atmosphere. Tab. 3 describes the results of the three different strip types in sand under normal pressure of 0.05 Atmosphere. Tab. 4 describes the results of the three different strip types in graded crushed stone under normal pressure of 0.05 Atmosphere.

TABLE 1

Pullout resistance and deformation in three different strips, embedded in sand, under normal pressure of 0.15 Atmosphere

| Flap Type | pullout resistance (N/cm) | Deformation (mm) | Deformation (% of embedded length) |
|---|---|---|---|
| REF | 14.7 | 0.55 | 0.11 |
| REF-P | 14 | 1.9 | 0.38 |
| FLAP | 12 | 0.7 | 0.14 |

In REF and REF-P samples, the strip was deforming by plastic deformation but also moved relatively to the GRM. In FLAP sample, only plastic deformation was observed.

TABLE 2

Pullout resistance and deformation in three different strips, embedded in graded crushed stone, under normal pressure of 0.15 Atmosphere

| Flap Type | pullout resistance (N/cm) | Deformation (mm) | Deformation (% of embedded length) |
|---|---|---|---|
| REF | 16.2 | 0.7 | 0.14 |
| REF-P | 16 | 2.1 | 0.38 |
| FLAP | 14 | 0.7 | 0.14 |

In REF and REF-P samples, the strip was deforming by plastic deformation but also moved relatively to the GRM. In FLAP sample, only plastic deformation was observed.

TABLE 3

Pullout resistance and deformation in three different strips, embedded in sand, under normal pressure of 0.05 Atmosphere

| Flap Type | pullout resistance (N/cm) | Deformation (mm) | Deformation (% of embedded length) |
|---|---|---|---|
| REF | 7.1 | 0.53 | 0.11 |
| REF-P | 5.8 | 1.5 | 0.30 |
| FLAP | 8.2 | 0.58 | 0.12 |

In REF and REF-P samples, the strip was deforming by plastic deformation but also moved relatively to the GRM. In FLAP sample, only plastic deformation was observed.

TABLE 4

Pullout resistance and deformation in three different strips, embedded in graded crushed stone, under normal pressure of 0.05 Atmosphere

| Flap Type | pullout resistance (N/cm) | Deformation (mm) | Deformation (% of embedded length) |
|---|---|---|---|
| REF | 9.2 | 0.51 | 0.10 |
| REF-P | 7.4 | 1.15 | 0.23 |
| FLAP | 7.9 | 0.44 | 0.09 |

In REF and REF-P samples, the strip was deforming by plastic deformation but also moved relatively to the GRM. In FLAP sample, only plastic deformation was observed.

From TABLE 1 to TABLE 4, the effect of flaps on the resistance to deformation under low normal stress is significant. While un-perforated strips are more resistant against plastic deformation, the friction with GRM is not excellent, so at least part of deformation is due to slip of strip in the GRM. The perforated strips are the worst—in one hand less stiff than the un-perforated strip, thus more subjected to plastic deformation, but in the other hand, has poor friction with GRM, so as tend to slip as the un-perforated strip. Surprisingly, the flap-perforated strips, behave different: The plastic deformation is almost as low as the un-perforated strip, due to better friction with GRM, so as stress is distributed between GRM and strip. The more significant difference is that the flap-perforated strips, did not moved at all relative to GRM, due to excellent friction.

The invention claimed is:

1. A cellular confinement system comprising a plurality of elongated strips arranged in a side by side pattern, each elongated strip being segmentally bonded to an adjacent strip in spaced-apart bonding areas, said bonding areas alternating between the sides of each of said strips, such that when said system is stretched across its width, said strips form a web of cells, each cell being defined by two cell walls disposed between said bonding areas; wherein a cell wall includes an aperture and a plurality of flaps extending into the aperture, each flap having a hinge end and a free end, the hinge end being attached to the cell wall, the flap being flat between the hinge end and the free end, each flap having a flap area, wherein a total flap area is less than an area of the aperture.

2. The cellular confinement system according to claim 1 wherein at least a portion of one of the two cell walls is embossed.

3. The cellular confinement system according to claim 1 wherein at least a portion of one of the two cell walls is perforated.

4. The cell web according to claim 1, wherein each flap is formed from a polygonal pattern, a curved pattern, or a combination thereof.

5. The cellular confinement system according to claim 1, wherein each flap is of a protuberant behavior and adapted to spontaneously extend from the cell wall when the system is stretched across its width.

6. The cellular confinement system according to claim 1, wherein the plurality of flaps is adapted to extend from the cell wall only when (i) a pressure gradient higher than a first predetermined measure is provided across said wall, (ii) a normal stress lower than a second predetermined measure is provided, or a combination of the two; wherein said first and second predetermined measures are from about 0.05 to about 0.6 Atmosphere.

7. The cellular confinement system according to claim 1, wherein the flap area of each flap is from about 0.04 $cm^2$ to 21 $cm^2$.

8. The cellular confinement system according to claim 1, wherein the area of the aperture is from about 0.04 $cm^2$ to 21 $cm^2$.

9. A method for minimizing the relative displacement between a cellular confinement system (CCS) and geotechnical reinforced material (GRM) infilling the same by creating an anchoring system extending from the CCS's walls and interlocking the CCS and the GRM; said method comprising a. obtaining a cellular confinement system comprising a plurality of elongated strips arranged in a side by side pattern, each of said strips being segmentally bonded to an adjacent strip in spaced-apart bonding areas, said bonding areas alternating between the sides of each of said strips, such that when said structure is stretched across its width, said strips form a web of cells confined by cell walls disposed between said bonding areas; and b. at each of said cell walls, forming an incision in said wall to make an aperture and a plurality of flaps extending into the aperture, each flap having a hinge end and a free end, the hinge end being attached to the cell wall, the flap being flat between the hinge end and the free end, each flap having a flap area, wherein a total flap area is less than an area of the aperture.

10. The method according to claim 9, wherein each cell wall has an L*H plane, and each flap is free to rotate around at least one rotating axis on the L*H plane.

11. The method according to claim 9, additionally comprising providing at least one perforated cell wall.

12. The method according to claim 9, additionally comprising providing a cell wall having at least an embossed portion.

13. The method according to claim 9, wherein the incision is such that each flap is shaped from a polygonal pattern, a curved pattern or a combination thereof.

* * * * *